US008116492B2

(12) United States Patent
Sattler et al.

(10) Patent No.: US 8,116,492 B2
(45) Date of Patent: Feb. 14, 2012

(54) RECHARGEABLE HEARING DEVICE

(75) Inventors: Michael Sattler, Erlangen (DE); Christian Schmitt, Grossenseebach (DE); Erwin Singer, Eckental (DE); Markus Trautner, Nürnberg (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1132 days.

(21) Appl. No.: 11/983,342

(22) Filed: Nov. 8, 2007

(65) Prior Publication Data

US 2008/0107298 A1 May 8, 2008

(30) Foreign Application Priority Data

Nov. 8, 2006 (DE) ..... 10 2006 052 712

(51) Int. Cl.
*H04R 25/00* (2006.01)

(52) U.S. Cl. ..... 381/323; 381/322; 381/330

(58) Field of Classification Search ..... 381/312, 381/323, 324, 328, 330, 331; 320/107, 108; 429/96, 97, 100
See application file for complete search history.

(56) References Cited

U.S. PATENT DOCUMENTS

| | | | | |
|---|---|---|---|---|
| 3,070,748 | A | 12/1962 | Worobey et al. | |
| 4,710,693 | A | 12/1987 | Wigell | |
| 5,253,300 | A | 10/1993 | Knapp | |
| 5,610,494 | A | 3/1997 | Grosfilley | |
| 6,215,981 | B1 | 4/2001 | Borchardt et al. | |
| 6,498,455 | B2 | 12/2002 | Zink et al. | |
| 7,062,057 | B2 * | 6/2006 | Wu | 381/323 |
| 2008/0118093 | A1 * | 5/2008 | Klemenz et al. | 381/324 |
| 2008/0136369 | A1 * | 6/2008 | Klemenz et al. | 320/107 |

FOREIGN PATENT DOCUMENTS

| | | | |
|---|---|---|---|
| DE | 693 00 870 | T2 | 12/1994 |
| DE | 69405709 | T2 | 11/1995 |
| DE | 19638953 | A1 | 3/1998 |
| DE | 29712244 | U1 | 6/1998 |
| DE | 202004012084 | U1 | 11/2004 |
| DE | 202005008982 | U1 | 9/2005 |
| EP | 0 630 549 | B1 | 12/1994 |

* cited by examiner

*Primary Examiner* — Huyen D Le

(57) ABSTRACT

The hearing device operated with an accumulator and comprising an externally accessible electrically conductive structure element is provided. The structure element fulfilling an additional function as a contact element, in order to receive a charging current when electrically connected to an external charging device. The term "structure element" is understood in the context of the present invention to mean an element, which is constitutively present in the structure of the hearing device due to its construction, e.g. the structure element can be a housing element, a fastening element, such as a screw, a control element, a nameplate or suchlike.

8 Claims, 1 Drawing Sheet

RECHARGEABLE HEARING DEVICE

CROSS REFERENCE TO RELATED APPLICATIONS

This application claims priority of German application No. 102006052712.7 DE filed Nov. 8, 2006, which is incorporated by reference herein in its entirety.

FIELD OF INVENTION

The present invention relates to a hearing device, which can be operated with an accumulator.

BACKGROUND OF INVENTION

Hearing devices are conventionally operated with replaceable batteries. By virtue of the recently improved accumulator technology, it has in the meantime become possible to operate hearing devices with accumulators. These need to be recharged at regular intervals. In order to recharge the accumulator, it is necessary to insert it into a charging device for recharge purposes. To this end, the accumulator has to be removed from the hearing device, which is a laborious and tedious process, particularly for older hearing device wearers. To avoid this, it is possible to recharge the accumulator in the hearing device. In addition, a hearing device is described in the European Patent EP 0 630 549 B1, which can be charged by way of charging pins, which engage in openings in the hearing device housing. This is disadvantageous in that dirt can enter these openings.

U.S. Pat. No. 6,498,455 describes a hearing device with an accumulator, which is equipped with an inductor coil and can be recharged in a charging device in a contact-free fashion by means of induction.

SUMMARY OF INVENTION

One disadvantage of inductively chargeable accumulators is the high technical outlay, since additional components, such as a charging circuit and a charging coil are necessary, as well as the long duration of the charging process (e.g. more than 12 hours) resulting from the minimal charging current. The aim of the present invention is to create a hearing device which can be operated with an accumulator, in which the disadvantages of the prior art are avoided.

In accordance with the invention, this aim is achieved by the hearing device as claimed in the independent claims. Advantageous developments of the hearing device according to the invention are specified in the dependent claims.

The hearing device according to the invention can be operated with an accumulator and comprises an externally accessible electrically conductive structure element, with the structure element fulfilling an additional function as a contact element in order to receive a charging current when electrically connected to an external charging device. "Structure element" in the context of the present invention is understood to mean an element which is constitutively present in the structure of the hearing device and fulfills its own function, e.g. the structure element can be a housing element, a fastening element, like a screw, a control element, a nameplate or suchlike. The structure element thus fulfills a dual function: on the one hand as a structure element, i.e. as an element of the hearing device structure or the hearing device function, on the other hand as a contact element, in order to set up an electrical connection to a charging device, in order to receive a charging current. The advantage of the present invention lies in a structure element being used as a contact element, said structure element being present in any event in the hearing device due to its construction. No additional part is thus necessary for the contact element, thereby signifying a space saving. On the whole, the hearing device can thus be configured to be smaller, which feels good for the wearer.

According to a preferred aspect of the present invention, an exterior surface of the structure element lies essentially flush with a housing surface of the hearing device housing. This is advantageous in that an essentially smooth housing surface is maintained and no dirt can accumulate on additional projections or recesses of the housing.

In addition, provision is also made for a charging device for the inventive hearing device which can be operated with an accumulator, said charging device comprising a receptacle for the hearing device, it being possible to bring a charging contact of the charging device into electrical contact with a structure element of the hearing device, which acts as a contact element.

The structure element of the hearing device in the receptacle of the charging device can preferably be pressed against the charging contact of the charging device using pretension. This can be achieved by the charging device comprising a tensioning device for instance, in order to mount the hearing device in the receptacle, e.g. a spring clip, a spring lug or such like. The charging device is preferably configured in the manner of a container, with the hearing device being inserted into the receptacle provided therefor and a cover, which can be attached to the charging device with a hinge for instance, being used as a tensioning device for mounting and fixing the hearing device.

Furthermore, a correct polarity of the charging contact is preferably predetermined by the charging position of the hearing device in the receptacle of the charging device. This can be achieved for instance by the spatial embodiment of the receptacle, which is tailored to the shape of the hearing device, thereby only rendering a correct charging position possible.

BRIEF DESCRIPTION OF THE DRAWINGS

Further characteristics of the present invention are obvious on the basis of the exemplary embodiment and the appended drawings, in which.

DETAILED DESCRIPTION OF INVENTION

Figure 1:
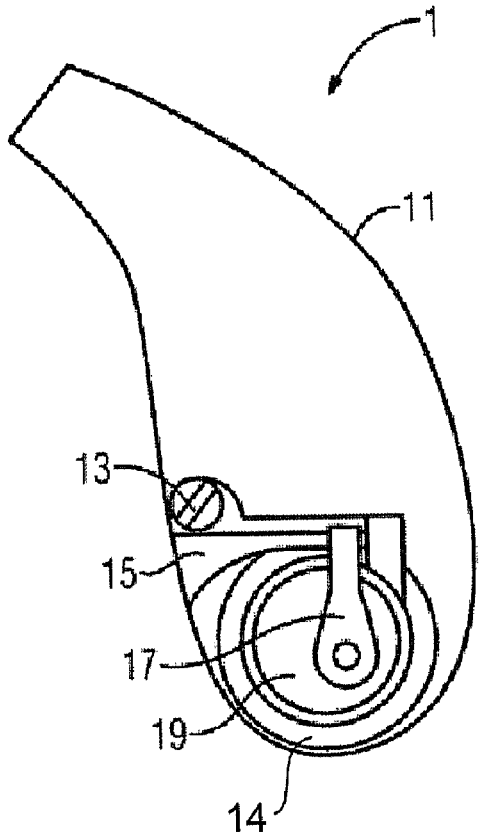
FIG. 1 shows a schematic partially cutout view of a first embodiment of a hearing device according to the invention.

FIG. 1 shows the hearing device unit 1 of a behind-the-ear hearing device (BTE). The hearing tube leading to the ear and the otoplastic are not shown. The housing 11 of the hearing device unit 1 is shown partially broken off and/or open. A screw 13, which is used as a structure element for fastening hearing device components, is arranged in the hearing device. An enclosure 14 offers a receptacle for a metal tongue 17 and the accumulator 19. The metal tongue 17 is connected to the (likewise metallic) screw 13 and establishes the electrical connection to the accumulator 19.

The screw 13 protrudes through an opening of the housing (not shown), with the screw head preferably lying essentially flush with the surrounding housing surface.

Figure 2:
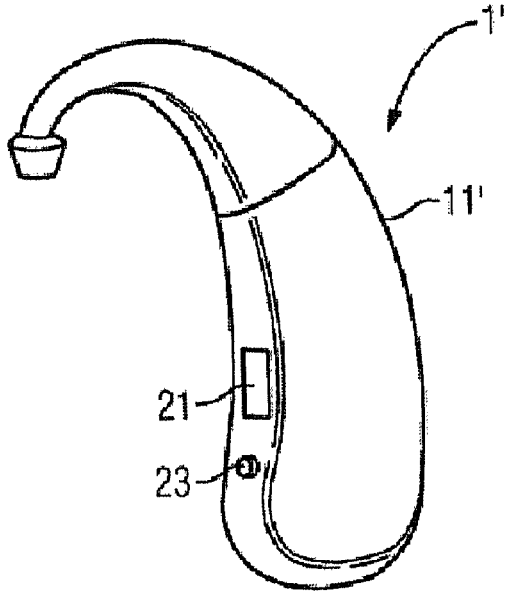
FIG. 2 shows a schematic view of a second embodiment of a hearing device according to the invention

FIG. 2 shows an alternative embodiment 1' of a BTE with housing 11', in which the nameplate 21 is embodied as a contact element and a control element 23 is embodied as a further contact element. The nameplate 21 can be covered with a conductive paint, so that it can be used as a contact element. The control element 23 is a push-button or a turn-switch for instance, which is made of a conductive material.

It is conceivable as an alternative embodiment for instance for a housing part, e.g. a half shell of the housing, to function as a contact element.

Applying a conductive marking to the housing part and using it as a contact element is also conceivable as a further alternative.

The invention can be implemented both with an in-the-ear hearing device (ITE) and with a BTE.

Numerous modifications are generally conceivable within the scope of protection of this invention in respect of the arrangement of the accumulator, the structure element functioning as a contact element and the geometry of the hearing device. The exemplary embodiments only represent exemplary and illustrative embodiments of the present invention.

The invention claimed is:

1. A hearing device operable with an accumulator, the hearing device comprising:

a plurality of elements interconnected to form the hearing device, each of the plurality of elements arranged to provide at least a respective mechanical, informational and/or control function with respect to the hearing device, at least one of said elements arranged as an externally accessible electrically conductive structure element, wherein said at least one structure element fulfills an additional function beyond the respective mechanical, informational and/or control function provided by said at least one structure element, wherein the additional function fulfilled by said at least one structure element is an electrical function performed as an electrical contact element to receive a charging current when electrically connected to an external charging device.

2. The hearing device as claimed in claim 1, wherein the structure element is a housing element.

3. The hearing device as claimed in claim 1, wherein the structure element is a fastening element.

4. The hearing device as claimed in claim 1, wherein the structure element is a screw.

5. The hearing device as claimed in claim 1, wherein the structure element is a nameplate.

6. The hearing device as claimed in claim 1, wherein the structure element is a control element.

7. The hearing device as claimed in claim 1, wherein an exterior surface of the structure element lies essentially flush with a housing surface of the hearing device.

8. A method for constructing a hearing device operable with an accumulator, the method comprising:

interconnecting a plurality of elements to form the hearing device;

arranging each of the plurality of elements to perform at least a respective mechanical, informational and/or controlling function with respect to the hearing device;

disposing at least one of said elements as an externally accessible electrically conductive structure element;

performing an additional function beyond the respective mechanical, informational and/or control function with said at least one structure element, wherein the additional function performed by said at least one structure element is an electrical function performed as an electrical contact element; and arranging said at least one structure element to receive a charging current when said at least one structure element is electrically connected to an external charging device.

* * * * *